US010975524B2

(12) United States Patent
Lewis et al.

(10) Patent No.: US 10,975,524 B2
(45) Date of Patent: Apr. 13, 2021

(54) PROCESS FOR MAKING PAPER WITH IMPROVED FILLER RETENTION AND OPACITY WHILE MAINTAINING WET TENSILE STRENGTH

(71) Applicant: SOLENIS TECHNOLOGIES, L.P., Wilmington, DE (US)

(72) Inventors: Ashley Hawkins Lewis, Wilmington, DE (US); Mark Tracey Crisp, Leusden (NL)

(73) Assignee: SOLENIS TECHNOLOGIES, L.P., Wilmington, DE (US)

( * ) Notice: Subject to any disclaimer, the term of this patent is extended or adjusted under 35 U.S.C. 154(b) by 44 days.

(21) Appl. No.: 16/244,834

(22) Filed: Jan. 10, 2019

(65) Prior Publication Data

US 2019/0218718 A1 Jul. 18, 2019

Related U.S. Application Data

(60) Provisional application No. 62/617,938, filed on Jan. 16, 2018.

(51) Int. Cl.

| | |
|---|---|
| ***D21H 17/55*** | (2006.01) |
| ***D21H 17/36*** | (2006.01) |
| ***D21H 17/67*** | (2006.01) |
| ***D21H 21/20*** | (2006.01) |
| ***D21H 21/28*** | (2006.01) |
| ***D21H 17/37*** | (2006.01) |
| ***D21H 27/30*** | (2006.01) |
| ***D21H 27/26*** | (2006.01) |
| ***D21H 17/20*** | (2006.01) |

(52) U.S. Cl.

CPC ..... *D21H 17/55* (2013.01); *D21H 17/20* (2013.01); *D21H 17/36* (2013.01); *D21H 17/375* (2013.01); *D21H 17/67* (2013.01); *D21H 17/675* (2013.01); *D21H 21/20* (2013.01); *D21H 21/28* (2013.01); *D21H 27/26* (2013.01); *D21H 27/30* (2013.01)

(58) Field of Classification Search

None

See application file for complete search history.

(56) References Cited

U.S. PATENT DOCUMENTS

| | | | | |
|---|---|---|---|---|
| 5,679,219 | A | 10/1997 | Harms et al. | |
| 5,759,346 | A | 6/1998 | Vinson | |
| 6,429,267 | B1 | 8/2002 | Riehle | |
| 8,163,134 | B2 | 4/2012 | Sutman et al. | |
| 8,530,597 | B2 * | 9/2013 | Kurian | D21H 21/18 526/303.1 |
| 9,719,212 | B2 | 8/2017 | Crisp et al. | |
| 2004/0221977 | A1 | 11/2004 | Vergara Lopez | |
| 2005/0155731 | A1 | 7/2005 | Martin et al. | |
| 2014/0053996 | A1 * | 2/2014 | Esser et al. | D21H 23/04 162/164.3 |
| 2016/0059530 | A1 | 3/2016 | Announ et al. | |

FOREIGN PATENT DOCUMENTS

| | | | |
|---|---|---|---|
| CA | 2968668 | A1 | 6/2016 |
| CN | 101435169 | A | 5/2009 |
| CN | 102174761 | A | 9/2011 |
| CN | 102174768 | A | 9/2011 |
| CN | 102174769 | A | 9/2011 |
| DE | 102008046856 | A1 | 3/2010 |
| DE | 102013100353 | A1 | 8/2013 |
| JP | 2011219874 | A | 11/2011 |
| SU | 1481307 | A1 | 5/1989 |

OTHER PUBLICATIONS

Smook, Gary A., Handbook for Pulp and Paper Technologists, 2nd ed, Angus Wilde Publications, 1992, pp. 220 and 225. (Year: 1992).*

Titanium Dioxide Compound Summary, PubChem, 2 pages, [online], retrieved from the Internet, [retrieved Apr. 17, 2020], <URL: https://pubchem.ncbi.nlm.nih.gov/compound/Titaniunn-dioxide>. (Year: 2020).*

ISA USPTO, International Search Report and Written Opinion issued in International Application No. PCT/US2019/013048, dated Mar. 29, 2019.

Wikipedia "Retention Agent", Jun. 23, 2016, https://en.wikipedia.org/wiki/Retention_agent, Section "Applications".

Domtar, "Paper Making 101: Inside Our Paper-Making Process," Aug. 22, 2016, https://newsroom.domtar.com/paper-making-101-inside-paper-making-process/, Section "Forming".

Horiuci, "Calculation of the surface potential and surface charge density by measurement of the three-phase contact angle," Journal of Colloid and Interface Science, Nov. 1, 2012, p. 218-224, vol. 385, Issue No. 1.

* cited by examiner

*Primary Examiner* — Dennis R Cordray

(74) *Attorney, Agent, or Firm* — Lorenz & Kopf, LLP

(57) ABSTRACT

A process is disclosed for making paper having improved filler retention and opacity. The process includes the step of adding Additive A and Additive B to a slurry in a wet end of a paper machine wherein the slurry comprises pulp and a filler. Additive A is a wet strength agent. Additive B is an anionic polymer having a charge density from about −3000 to about −7000 ueq/g on a dry basis when measured in a buffer having a pH of about 6. Additive B also has a weight average molecular weight of from about 150,000 to about 1,000,000, Daltons.

13 Claims, No Drawings

PROCESS FOR MAKING PAPER WITH IMPROVED FILLER RETENTION AND OPACITY WHILE MAINTAINING WET TENSILE STRENGTH

CROSS-REFERENCE TO RELATED APPLICATIONS

This application claims the benefit of U.S. Provisional Application No. 62/617,938, filed Jan. 16, 2018, which is expressly incorporated herein by reference in its entirety.

TECHNICAL FIELD

The present disclosure generally relates to a process that provides filler retention and opacity to paper while maintaining wet tensile strength. More specifically, the present disclosure relates to use of a wet strength agent and a particular anionic polymer which are added to a slurry in a wet end of a paper machine.

BACKGROUND

The prior art discloses various attempts to improve different aspects of décor (laminating) grades of paper, see for example, CN102174761, U.S. Pat. No. 5,679,219, JP2011219874, CN102174768, CN102174769, CN101435169, DE102008046856, CN102174761, US2016059530, and SU1481307. Some prior art discloses increasing of filler content such as U.S. Pat. Nos. 8,163,134, 5,759,346, while other art focuses on opacity, e.g. DE102013100353. Still other art discloses retention and drainage such as US patent 20040221977. However, there remains a need in the industry to maintain or improve filler retention, opacity and wet strength in highly filled paper.

BRIEF SUMMARY

This disclosure provides a process for making paper having opacity and filler retention. The process includes the step of adding Additive A and Additive B to a slurry in a wet end of a paper machine wherein the slurry comprises pulp and a filler. Additive A is a wet strength agent. Additive B is an anionic polymer having a charge density from about −3000 to about −7000 ueq/g on a dry basis when measured in a buffer having a pH of about 6. Additive B also has a weight average molecular weight of from about 150,000 to about 1,000,000, Daltons.

DETAILED DESCRIPTION

One problem addressed in the current disclosure is the preparation of paper, such as base paper. This paper can be used for laminating applications that exhibits improved or ideal properties relative to at least one of filler retention, opacity, and/or wet strength.

In one embodiment, the current disclosure improves one or more of these properties in relation to a base PAE resin addition alone by adding an anionic co-additive with particular charge and/or molecular weight properties. In this way, base sheets with high levels of opacity and filler retention can be manufactured without a negative impact upon the wet tensile strength. Alternatively, continued improvements in wet tensile strength can be made without negatively impacting the filler retention and opacity of the sheet.

In other embodiments, the present disclosure describes a method for making paper, e.g. filled paper grades, especially décor paper grades, with high opacity and filler retention while maintaining wet tensile strength. Alternatively, the present disclosure describes a method for making paper, e.g. filled paper grades, especially décor paper grades, with improved opacity and filler retention while maintaining wet tensile strength.

In various embodiments, the paper is at least about 80, 85, 90, or 95, % opaque after lamination to be considered high opacity as measured by Technidyne Brightimeter TAPPI Method T425. In other embodiments, the method is directed towards making paper with a minimum basis weight of about 50 grams per square meter (gsm), typically at least about 55 or about 60 gsm. In other embodiments, the method includes the step of adding two additives, Additive A and Additive B, to a wet end of a paper making process, e.g. to a slurry that includes pulp and a filler. In various non-limiting embodiments, all values and ranges of values, both whole and fractional, including and between those set forth above, are hereby expressly contemplated for use herein.

The slurry may be any known in the art of papermaking and may be described as a pulp slurry or as a pulp and filler slurry. The slurry may be any known in the art, for example, based on virgin pulp, deinked pulp (DIP), unbleached Kraft pulp (UBK), mechanical pulps like thermal mechanical pulp (TMP), semi-chemical mechanical pulps like neutral sulfite semi-chemical (NSSC), old corrugated containers (OCC), recovered newspaper, recovered tissue or other fiber sources. The pulp may be present in the slurry in any amount known in the art.

In various embodiments, Additive A may be or include a wet strength additive such as polyamidoamine-epichlorohydrin (PAE). Additive B may be or include an anionic polymer with particular properties described below. Other additives can be used in the papermaking process in addition to these two additives and the filler utilized in this disclosure. Alternatively, the slurry may be free of, or include less than 5, 4, 3, 2, 1, 0.5, or 0.1, weight percent of one or more additives that is not Additives A or B or the filler. These excluded additives may be one or more optional additives described below and/or one or more additives known in the art of papermaking. In various non-limiting embodiments, all values and ranges of values, both whole and fractional, including and between those set forth above, are hereby expressly contemplated for use herein.

In various embodiments, Additive B is an anionic polymer having a charge density between about −3000 and about −7000 ueq/g (dry basis) when measured at pH of about 6, and has a weight average molecular weight of from about 150,000 to about 1,000,000 daltons. In various embodiments, this method provides improved opacity, filler retention, and/or wet tensile strength as compared to a comparative method that utilizes no chemicals additives, and/or as compared to a comparative method that utilizes Additive A alone. In various non-limiting embodiments, all values and ranges of values, both whole and fractional, including and between those set forth above, are hereby expressly contemplated for use herein.

Processes for making décor (laminating) grades of paper typically involve the use of high filler loadings to provide opacity to a final laminated product. The lamination process typically involves wetting base paper in an aqueous resin followed by curing. The base paper must have sufficient wet strength to survive downstream processing. Chemical additives which are added to the wet end of a papermaking machine typically impact filler retention and therefore opacity. In various embodiments, this disclosure provides for the use of two additives: Additive B, an anionic polymer, with particular molecular weight and charge density, and Additive A, a wet strength resin, typically polyamidoamine-epichlorohydrin (PAE). In other embodiments, the disclosure provides filler retention and opacity better than that of sheets made with PAE alone while maintaining wet tensile strengths similar to that of sheets made with PAE alone. The properties of the Additive B can be important in providing all three properties since some anionic additives will negatively impact one or more of the properties. Although the disclosure is directed to décor grades of paper it may also apply to any other type of paper, including, but not limited to, Printing & Writing grades with high filler loadings.

To address the negative impacts of high levels of PAE resin in laminating (décor) grades of paper, an anionic polymer is typically added to a wet end of a papermaking system in combination with a wet strength agent. As used herein, the term "laminating", "laminate", "laminated", "décor base", or "décor" paper refers to a particular grade of paper made with high levels of filler loading in order to provide opacity to the final laminated product. Highly filled paper is paper that has an ash content measurement of greater than about 15% as measured according to TAPPI T413 OM-11. The resulting, highly filled paper is typically either loaded with resin particles (pre-impregnated) or is subjected to a resin impregnation step to fill a sheet of paper with a curable aqueous resin, such as melamine-formaldehyde or phenolic formaldehyde. In general, usage of the term "décor or decorative laminate" refers to sheets of paper that have decorative properties that are impregnated and consolidated under heat and pressure with plies of core paper or particleboard. In one embodiment, a formal definition from ISO 472 designates a decorative laminate as a laminate including bonded layers of sheet material (for example paper, film, foil or fabric), wherein an outer layer or layers on one or both sides having decorative plain or variegated colors or designs. The class of decorative laminates can further be categorized in several categories, including high-pressure laminates, decorative continuous laminates, direct-faces boards, and composite boards. The term decorative laminate used in the context of the current disclosure typically includes base sheets prepared for decorative paper lamination process.

The decorative laminate base papers typically have certain mechanical properties in order to remain intact through resin impregnation processing. Resin impregnation processing typically includes unwinding a sheet and adding a controlled amount of resin to the sheet through a metering process. In most cases, solvents are driven off through drying in order to create a semi-cured sheet that can then be used in the lamination process. The sheets are then cut to the target size, assembled or layered, and added to a press where temperature and pressure are used to cure the resin. In most decorative laminates, melamine-formaldehyde is used due to its hardness, clarity, resistance to chemicals, staining, moisture, and heat, and its light stability. Due to the nature of the resin impregnation and curing steps, a wet strength additive is typically used in the papermaking process to impart wet strength to the sheet to allow for processing. This allows for the sheet to remain intact through the resin impregnation steps, and if applicable, stacking, and curing. Various wet strength chemistries have been used but most commonly polyamidoamine-epichlorohydrin (PAE) resins are used in the wet end of the papermaking process. The structure of PAE resins is described in U.S. Pat. Nos. 9,719,212 and 6,429,267, each of which is incorporated herein by reference in various non-limiting embodiments. The PAE used in the present disclosure is a water-soluble polymer and is used to provide wet strength to paper. Several PAE resins are commercially available and marketed under various names including Kymene™ (Solenis LLC, Wilmington, Del.), Fennostrength™ (Kemira, Helsinki, Finland), and Maresinu (Mare SpA, Milan, Italy).

The base sheet typically has sufficient opacity to provide the desired opacity to the final laminate. In the sheet prior to impregnation and curing, the opacity is due to both the cellulose fibers and filler particles. Upon resin impregnation and curing, the refractive index of the cellulose fibers is changed to approximately that of air. Thus, sheet opacity is a function of the filler loading and distribution. Typical filler loadings can be up to about 60% by weight of the sheet. The filler is typically titanium dioxide. However, the filler can alternatively be or include clay, calcium carbonate, and/or other fillers known to those in the art including pigments and dyes. Titanium dioxide is a typical filler due to its optical and light scattering properties, but does have a high cost. Titanium dioxide can be of either the anatase or rutile type. The objective of many manufacturers is to retain as much filler as possible in the paper, but do so in a manner to obtain the best opacity for the filler loading. The filler particles should disperse uniformly throughout the sheet and avoid excessive flocculation.

As used herein, the term "retention" or "filler retention" refers to the filler retention in the sheet, not that of the fines and fibers. This is a measurement based on the amount of dosed filler particle retained in the final paper sheet, as determined by ash analysis using any method known in the art.

The present disclosure discloses that, in various embodiments, the use of an anionic additive, Additive B, with particular molecular weight and charge density properties in conjunction with Additive A, provides the three properties of (improved) filler retention, opacity and wet strength, which are important for laminating grades of paper. Standard, high molecular weight filler retention aids are able to provide improved filler retention and opacity over the base case with PAE resin alone, but the wet strength is negatively impacted. The combination of wet strength resin and anionic Additive B described in this disclosure is able to provide filler retention and opacity improvements greater than that of the standard filler retention aids while also improving the wet tensile peak load and wet tensile index of the sheet. Thus all three properties are improved through the combination of this anionic Additive B and Additive A.

Additive A is a wet strength agent, typically polyamidoamine-epichlorohydrin (PAE) resin, and Additive B is an anionic polymer or co-additive. The combination of Additive A and Additive B in the wet end, in the presence of pulp fibers and filler particles, allows for improved filler retention, opacity, and wet tensile strength over the case with Additive A dosed alone. Surprisingly, it was found that the use of Additive B provides filler retention and opacity levels higher than that of Additive A alone, even at the same added chemical charge density. Thus, the effect of the Additive B is due to a synergistic effect rather than just charge balancing of the cationic resin molecule. The anionic Additive B used in this disclosure provides improved filler retention and opacity as well as wet tensile properties as compared to the case of Additive A alone.

Additive A typically includes a wet strength agent. Additive A can be any one or more of the following, melamine formaldehyde, urea formaldehyde, glyoxalated polyacrylamides, polyamidoamine-epichlorohydrin and others known to those in the art. A typical Additive A includes a polyamidoamine-epichlorohydrin wet strength resin.

Additive B typically includes an anionic polymer including, but not limited to, acrylic acid based polymers, copolymers of acrylamide and acrylic acid or methacrylic acid, carboxymethyl cellulose (CMC), anionically modified polyvinyl alcohol, and other anionic polymers known to those skilled in the art.

In various embodiments, Additive B includes an anionic polymer including, but not limited to, anionic polyacrylamides copolymers, anionic polyacrylamide terpolymers, carboxymethyl cellulose, guar gum derivatives, modified anionic polyvinyl alcohols, and combinations thereof and other anionic polymers know to those skilled in the art.

When Additive B is polyacrylamide, it can be based upon one or more of acrylamide, methacrylamide, ethacrylamide and the like, in combination with one or more anionic monomers such as, one or more of acrylic acid, methacrylic acid, acrylate esters, acrylate salts, including sodium, potassium and ammonium salts, and the like, itaconic acid, fumaric acid, crotonic acid, citraconic acid, maleic acid, and salts thereof, 2-acrylamido-2-methylpropane sulfonic acid, styrene sulfonic acid, vinyl sulfonic acid, and the like. Additional monomer used to form the polyacrylamide can include N-vinyl pyrrolidone, N,N-diallylmethacrylamides, hydroxyalkyl methacrylates, N-vinylformamide and the like. Small quantities of other copolymerizable monomers, such as methyl acrylate, methyl methacrylate, acrylonitrile, vinyl acetate, styrene, and the like may also be used to further modify the polyacrylamide.

Additive B can be an anionic polymer based on polyvinyl alcohol or anionic functionalized polyvinyl alcohol. Additive B can further include one or more anionic monomers such as, one or more of acrylic acid, methacrylic acid, acrylate esters, acrylate salts, including sodium, potassium and ammonium salts, itaconic acid, fumaric acid, crotonic acid, citraconic acid, maleic acid, and salts thereof, 2-acrylamido-2-methylpropane sulfonic acid, styrene sulfonic acid, vinyl sulfonic acid, N-vinyl pyrrolidone, N,N-diallylmethacrylamides, hydroxyalkyl methacrylates, N-vinylformamide and combinations thereof.

Additive B has a particular charge density when measured by a Mütek Particle Charge Detector, or other titration based streaming current detector. The charge density when measured in a buffer at pH of about 6 is typically of from about −3000 to about −7000 ueq/g dry polymer, more typically of from about −4000 to about −6000 ueq/g, and most typically of from about −5000 to about −5500 ueq/g. In various non-limiting embodiments, all values and ranges of values, both whole and fractional, including and between those set forth above, are hereby expressly contemplated for use herein.

In various embodiments, Additive B is an anionic polymer and has a typical weight average molecular weight of from about 150,000 to about 1,000,000 daltons, more typically about 300,000 to about 800,000, most typically about 500,000 to about 700,000 daltons when measured by size exclusion chromatography. The performance of Additive B in the papermaking system can be highly dependent on the molecular weight and charge density of the anionic polymer. As is demonstrated in the Examples, anionic additives with high molecular weights, outside of those used in the present disclosure, tend to result in poor tensile strength in the resulting paper. One typical useful example of Additive B is Hercobond™ 2800 dry-strength additive (a copolymer of acrylamide and acrylic acid, available from Solenis LLC, Wilmington, Del.), a polymer having a charge density at a pH of about 6 of from about −5000 to about −6000 ueq/g and a weight average molecular weight of from about 600,000 to about 700,000 daltons. In various non-limiting embodiments, all values and ranges of values, both whole and fractional, including and between those set forth above, are hereby expressly contemplated for use herein.

Additives A and B can be added in the wet-end simultaneously or in sequence. For simultaneous addition, the two additives can be introduced into the wet end at the same time but through separate addition points so as not to combine the two prior to addition. Addition points will be dependent on the papermaking conditions and therefore could be added in different sequences or positions in the papermaking process. The addition of one or both additives can be split and added at different addition points in the wet end papermaking system. In a typical embodiment, a filler is blended with a pulp slurry first, followed by the addition of Additive A, then Additive B. Alternative addition points and schemes can be implemented including the addition of Additive B prior to Additive A. All orders of addition of Additives A and B, both when added in whole amounts and when added in a series of partial amounts, are hereby expressly contemplated for use herein.

Additives A and B can be added at various dosages depending upon the desired paper properties for the intended application. In one typical embodiment, Additive A is added (e.g. dosed) in an amount of from about 1 to about 60 lbs/ton of cellulose fiber on a dry basis, typically of from about 10 to about 50, and more typically of from about 20 to about 40 lbs/ton. In other embodiments, Additive B is dosed to the wet end in an amount of from about 0.5 to about 30 lbs/ton based on the amount of dry cellulose fiber, typically about 1 to about 25, and more typically about 2 to about 10. The ratio of Additive A to Additive B can be from about of about 2:1 to about 20:1 by weight, based upon the dry polymer content of the additives, typically about 4:1 to about 15:1, more typically about 4:1 to about 10:1. In various non-limiting embodiments, all values and ranges of values, both whole and fractional, including and between those set forth above, are hereby expressly contemplated for use herein.

The ratio of filler to pulp furnish can be from about 25:100 to about 150:100 by weight on a dry basis, or the filler dosage required to achieve paper ash contents of from about 5% to about 60%, typically of from about 10% to about 50%, and most typically of from about 25% to about 45%. In various non-limiting embodiments, all values and ranges of values, both whole and fractional, including and between those set forth above, are hereby expressly contemplated for use herein.

Additional Embodiments

In further embodiments, this disclosure provides a process for making paper having improved opacity and improved filler retention. Typically, the process can produce paper having high opacity and high filler retention, as would be understood by one of skill in the art. The process includes the step of adding Additive A and Additive B to a slurry in a wet end of a paper machine, wherein the slurry includes pulp and an additive. Additive A is a wet strength agent. Additive B is an anionic polymer having a charge density from about −3000 to about −7000 ueq/g on a dry basis when measured in a buffer having a pH of about 6. In addition, Additive B has a weight average molecular weight of from about 150,000 to about 1,000,000, Daltons. Additive A and/or B may be any as described above. In various non-limiting embodiments, all values and ranges of values, both whole and fractional, including and between those set forth above, are hereby expressly contemplated for use herein.

In these embodiments, opacity and filler retention may be as described above. For example, the paper may have an opacity of at least about 80, 85, 90, or 95,% as measured by Technidyne Brightimeter TAPPI Method T425. In various non-limiting embodiments, all values and ranges of values, both whole and fractional, including and between those set forth above, are hereby expressly contemplated for use herein.

Filler retention may be described as a measurement based on the amount of dosed filler particle retained in a final paper sheet, as determined by ash analysis of the prepared paper sheet. In various embodiments, filler retention values are from about 36.7% (i.e., sheet ash content of approximately 22% from a sheet prepared with ~21.25 g of titanium dioxide (dry) and 14.157 g pulp (dry)) to about 95% (i.e., sheet ash content of approximately 43.45% from a sheet prepared with ~12 g titanium dioxide (dry) and 14.157 g pulp (dry)). Ash content can be determined via TAPPI method T413 om-11 at 900° C. The retention can be calculated by dividing the measured ash content by the theoretical ash content calculated by dividing the dosed titanium dioxide (dry basis) by the sum of the dosed titanium dioxide and pulp fiber (dry basis). In other embodiments, the filler retention values are from about 15 to about 95, about 20 to about 90, about 25 to about 85, about 30 to about 80, about 35 to about 75, about 40 to about 70, about 45 to about 65, about 50 to about 60, or about 55 to about 60, %, as determined as described above. In various non-limiting embodiments, all values and ranges of values, both whole and fractional, including and between those set forth above, are hereby expressly contemplated for use herein.

In various embodiments, Additive A is chosen from melamine formaldehyde, urea formaldehyde, glyoxalated polyacrylamides, polyamidoamine-epichlorohydrin, and combinations thereof. In other embodiments, Additive A includes or is polyamidoamine-epichlorohydrin.

In other embodiments, the filler is chosen from titanium dioxide, kaolin, calcium carbonate, pigments, dyes, and combinations thereof. The filler may be titanium dioxide. For example, the titanium dioxide may be an anatase and/or rutile type. In other embodiments, the paper is décor or laminate grade paper. Still further, the charge density of Additive B, measured at a pH of about 6, may be from about −4000 to about −6000 ueq/g on a dry basis. Moreover, the weight average molecular weight of Additive B may be from about 300,000 to about 800,000, Daltons. In various non-limiting embodiments, all values and ranges of values, both whole and fractional, including and between those set forth above, are hereby expressly contemplated for use herein.

In still other embodiments, Additive B is an anionic polyacrylamide that is or includes the reaction product of at least one of acrylamide, methacrylamide, or ethacrylamide and at least one anionic monomer chosen from acrylic acid, methacrylic acid, acrylate esters, acrylate salts, itaconic acid, fumaric acid, crotonic acid, citraconic acid, maleic acid, and salts thereof, 2-acrylamido-2-methylpropane sulfonic acid, styrene sulfonic acid, vinyl sulfonic acid, N-vinyl pyrrolidone, N,N-dialylmethacrylamides, hydroxyalkyl methacrylates, N-vinylformamide and combinations thereof. In one embodiment, Additive B is or includes an anionic copolymer comprising the reaction product of acrylamide and acrylic acid. In another embodiment, Additive B is or includes an anionic polymer comprising polyvinyl alcohol or anionic functionalized polyvinyl alcohol. In still a further embodiment, Additive B is or includes the reaction product of a first monomer and at least one anionic monomer chosen from acrylic acid, methacrylic acid, acrylate esters, acrylate salts, itaconic acid, fumaric acid, crotonic acid, citraconic acid, maleic acid, and salts thereof, 2-acrylamido-2-methylpropane sulfonic acid, styrene sulfonic acid, vinyl sulfonic acid, N-vinyl pyrrolidone, N,N-dialylmethacrylamides, hydroxyalkyl methacrylates, N-vinylformamide and combinations thereof.

In other embodiments, the slurry includes cellulose fiber as the pulp and Additive A is added in an amount of from about 1 to about 60 lbs per ton of dry cellulose fiber. Alternatively, the slurry may include cellulose fiber as the pulp and Additive B is added in an amount of from about 0.5 to about 30 lbs per ton of dry cellulose fiber. Moreover, the weight ratio of Additive A to Additive B may be from about 2:1 to about 20:1 on a dry weight basis. Alternatively, the weight ratio of Additive A to Additive B may be from about 4:1 to about 15:1. In other embodiments, the slurry includes filler and pulp and a ratio of filler to pulp is from about 25:100 to about 150:100 by weight on a dry basis. In other embodiments, the paper has an ash content of from about 5% to about 60%, by weight. In even further embodiments, the charge density of Additive B, measured at a pH of about 6, is from about −5000 to about −5500 ueq/g on a dry basis, the weight average molecular weight of Additive B is from about 500,000 to about 700,000 daltons, the slurry includes cellulose fibers, Additive A is added in an amount of from about 20 to about 40 lbs per ton of dry cellulose fiber, Additive B is added in an amount of from about 1 to about 20 lbs per ton of dry cellulose fiber, and the paper has an ash content of from about 25% to about 40%, by weight. In various non-limiting embodiments, all values and ranges of values, both whole and fractional, including and between those set forth above, are hereby expressly contemplated for use herein.

In other embodiments, the addition of Additive A and Additive B provides improved opacity, filler retention, and/or wet tensile strength as compared to adding only wet strength resin. In one embodiment, Additive A is added to the papermaking slurry prior to Additive B. In another embodiment, Additive A and Additive B are added to the papermaking slurry simultaneously. In a further embodiment, Additive B is added to the papermaking slurry prior to Additive A. In still another embodiment, Additive A is added at one or more locations in the papermaking process. Alternatively, Additive B may be added at one or more locations in the papermaking process.

In a further embodiment, the charge density of Additive B, measured at a pH of about 6, is from about −5000 to about −5500 ueq/g on a dry basis. In another embodiment, the weight average molecular weight of Additive B is from about 500,000 to about 700,000 daltons. In still another embodiment, a first monomer, which may be any known in the art, reacts with at least one anionic monomer chosen from acrylic acid, methacrylic acid, acrylate esters, acrylate salts, itaconic acid, fumaric acid, crotonic acid, citraconic acid, maleic acid, and salts thereof, 2-acrylamido-2-methylpropane sulfonic acid, styrene sulfonic acid, vinyl sulfonic acid, N-vinyl pyrrolidone, N,N-dialylmethacrylamides, hydroxyalkyl methacrylates, N-vinylformamide and combinations thereof. In various non-limiting embodiments, all values and ranges of values, both whole and fractional, including and between those set forth above, are hereby expressly contemplated for use herein.

In other embodiments, Additive A is added in an amount of from about 10 to about 50 lbs per ton of dry cellulose fiber. Alternatively, Additive A is added in an amount of from about 20 to about 40 lbs per ton of dry cellulose fiber. In other embodiments, Additive B is added in an amount of from about 1 to about 20 lbs per ton of dry cellulose fiber. Alternatively, Additive B is added in an amount of from about 1 to about 25 lbs per ton of dry cellulose fiber. Moreover, the weight ratio of Additive A to Additive B may be from about 4:1 to about 10:1. In addition, the paper may have an ash content of from about 10% to about 50%, by weight. Alternatively, the paper may have an ash content of from about 25% to about 40%, by weight. In various non-limiting embodiments, all values and ranges of values, both whole and fractional, including and between those set forth above, are hereby expressly contemplated for use herein.

In still other embodiments, the addition of Additive A and Additive B in the instant process provides improved opacity, retention, and wet tensile strength as compared to adding only wet strength resin.

All combination of all process steps and all compounds described herein are expressly contemplated for use herein in various embodiments, even if those process steps and/or compounds are not described in the same or similar paragraphs above and/or grouped together above.

EXAMPLES

Lab experimentation was completed by making handsheets on a Noble & Wood Handsheet mold. Sheets were prepared by adding a 30% titanium dioxide (R-796+, Chemours, Wilmington, Del.) wherein the slurry was adjusted to pH 9 to 1% eucalyptus pulp refined to approximately 300 mL Canadian Standard Freeness. The filler was added at 0.85 g dry filler to g dry pulp. The system pH was then adjusted to approximately 6 with dilute sulfuric acid. Sheets were then made on the handsheet mold with no white water recycle. Chemical additives were added to the pulp/filler slurry with overhead agitation. The PAE resin used was Kymene™ XRV20 (Solenis LLC, Wilmington, Del.), which was diluted to a 1% solution in water of standard hardness and alkalinity and the pH adjusted to 6. Various anionic additives were investigated and are noted in the particular examples. The pulp slurry was then added to the proportioner of the equipment and sheets were formed. Wet sheets were pressed at 60 psi and then dried on a drum dryer at approximately 115° C. The drum dryer was operated in a manner where the sheet was exposed to the drying surface for 35-40 seconds.

The resulting handsheets were aged for at least 2 weeks in a room with controlled temperature and humidity. The conditioning conditions were those outlined by TAPPI Method T 402 and the room was controlled at 50%+/−2% relative humidity and 23°+/−1.0° C. temperature. Ash content was measured using the TAPPI T413 om-11 method at 900° C. Percent retention was calculated by dividing the measured ash content by the theoretical ash content based upon the amount of pulp used and the amount of filler added. Opacity was measured using a Technidyne Brightimeter. Sheets were placed into clear plastic bags and the opacity was measured first on the dry sheets and then again on sheets that were soaked in vegetable oil (soybean oil) (Available from better Living Brands LLC, Pleasanton, Calif.). The oil soaking step removes the air from the sheet and correlates well to final laminated product opacity. Wet tensile strength was measured using TAPPI method 456 with 1" test strips, 5" gauge length, and a rate of 1 in/min. Basis weight was measured by weighing the mass of 7"×7" sheets cut from the handsheets.

Anionic polyacrylamide systems were characterized by both molecular weight and charge density. For charge density measurements, a Mütek PCD-05 particle charge detector was used. The anionic polyacrylamide samples were diluted to approximately 0.04% by weight in deionized water, then 2 mL of this solution was added to 8 mL of 0.01M phosphate buffer at pH 6 in the Mütek measuring cell. The samples were titrated with polydiallyldimethylammonium chloride ("polyDADMAC") until a streaming potential of 0 mV was measured. The reported values are based upon the dry weight of polymer.

Anionic polyacrylamide molecular weight was determined using size exclusion chromatography with the following conditions:

Mobile Phase: 0.1 M sodium nitrate/20% acetonitrile

Flow Rate: 0.8 ml/min

Columns: 2 TSKgel GMPWxl in series

Column Temperature: 40° C.

DRI Detector Temperature: 40° C.

Calibration: Relative to poly(acrylic acid) sodium salt, narrow molecular weight standards Sample Concentration: Typically 2 mg/ml in mobile phase Sample prep: Stir in mobile phase 1-2 hours.

Filtration: 0.45 μm PVDF syringe filter.

The properties of various anionic polyacrylamide additives are shown in Table 1. Additives B1-B9 are anionic polyacrylamides with various charge densities and molecular weights. Additives B1, B3, B4, and B5 are commercial samples available from Solenis LLC, Wilmington, Del. Additive B2 is a lab sample of acrylamide and acrylic acid co-polymers formulated with 25 mol percent acrylic acid. FLOPAM™ AN 905, FLOPAM™ AN 956 SH, and FLOPAM™ AN 995 SH are conventional anionic retention aids available from SNF Inc, Riceboro, Ga. Chemtall™ AN 956 VLM is also a conventional anionic retention aid available from Chemtall, Riceboro, Ga.

TABLE 1

| | Additive B | Charge at pH 6 (μeq/g solid) | Weight Average Molecular Weight (Daltons) |
|---|---|---|---|
| Additive B1 | Hercobond 2800 | −5060 | 646,000 |
| Additive B2 | Hercobond aPAM | −5091 | 173,000 |
| Additive B3 | Hercobond 2800 | −5060 | 646,000 |
| Additive B4 | Hercobond 2515 | −5859 | 582,000 |
| Additive B5 | Hercobond 2000 | −3688 | 406,000 |
| Additive B6 | FLOPAM AN 905 | −3872 | 6,651,000 |
| Additive B7 | FLOPAM AN 995 SH | −8910 | 5,819,000 |
| Additive B8 | Chemtall AN 956 VLM | −6927 | 5,190,000 |
| Additive B9 | FLOPAM AN 956 SH | −6754 | 5,423,000 |

Example 1 (Additive A Alone)

For comparison purposes, sheets were made with Kymene™ XRV20 wet-strength resin (a PAE resin) as Additive A alone at various wet strength dosages (0% to 3% based on dry fiber). The paper properties are shown in Table 2.

TABLE 2

| | Additive B | Additive A Dosage (based on dry fiber) | Ash (%) | Retention (%) | Dry Opacity |
|---|---|---|---|---|---|
| 2.1 | No Additive B | 0.0% | 26% | 58% | 97 |
| 2.2 | No Additive B | 1.0% | 30% | 66% | 98 |
| 2.3 | No Additive B | 1.5% | 25% | 54% | 97 |
| 2.4 | No Additive B | 2.0% | 22% | 47% | 96 |
| 2.5 | No Additive B | 2.5% | 20% | 44% | 96 |
| 2.6 | No Additive B | 3.0% | 19% | 42% | 96 |

| | Additive B | Additive A Dosage (based on dry fiber) | Oil Opacity | Basis Weight (gsm) | Dry Peak Load (N/m) | Wet Peak Load (N/m) |
|---|---|---|---|---|---|---|
| 2.1 | No Additive B | 0.0% | 90 | 70 | 1348 | 37 |
| 2.2 | No Additive B | 1.0% | 90 | 74 | 1857 | 475 |
| 2.3 | No Additive B | 1.5% | 87 | 70 | 2131 | 581 |
| 2.4 | No Additive B | 2.0% | 85 | 67 | 2347 | 650 |
| 2.5 | No Additive B | 2.5% | 84 | 66 | 2305 | 665 |
| 2.6 | No Additive B | 3.0% | 84 | 64 | 2316 | 683 |

The presence of the PAE resin initially improves the retention over that of the sheet with no additives. However, at higher PAE resin addition levels, the retention and opacity are decreased by the presence of additional PAE resin. The wet tensile strength continues to increase with increasing PAE dosage.

Example 2

Additive B1, an anionic polyacrylamide, was added after the PAE resin addition at a ratio of 2:1 Additive A to Additive B, by weight, on a dry basis. The paper properties are shown in Table 3.

TABLE 3

| | Additive B | Additive A Dosage (based on dry fiber) | Ash (%) | Retention (%) | Dry Opacity |
|---|---|---|---|---|---|
| 3.1 | Additive B1 | 1.0% | 42% | 92% | 98 |
| 3.2 | Additive B1 | 1.5% | 40% | 87% | 98 |
| 3.3 | Additive B1 | 2.0% | 40% | 87% | 98 |
| 3.4 | Additive B1 | 2.5% | 40% | 87% | 98 |

| | Additive B | Additive A Dosage (based on dry fiber) | Oil Opacity | Basis Weight (gsm) | Dry Peak Load (N/m) | Wet Peak Load (N/m) |
|---|---|---|---|---|---|---|
| 3.1 | Additive B1 | 1.0% | 93 | 91 | 2056 | 483 |
| 3.2 | Additive B1 | 1.5% | 92 | 95 | 2624 | 723 |

TABLE 3-continued

| | | | | | | |
|---|---|---|---|---|---|---|
| 3.3 | Additive B1 | 2.0% | 93 | 98 | 3246 | 965 |
| 3.4 | Additive B1 | 2.5% | 93 | 98 | 3329 | 1045 |

The combination of Additives A and B in the papermaking process provided much better retention than Additive A alone. This also resulted in improved opacity values. The wet tensile strength peak load also improved over all Additive A dosages, indicating no negative impact due to the increased retention. The retention, opacity, and wet peak load showed improvements over the corresponding PAE dosage results shown in the comparative example 1.

Example 3

For comparison, several anionic additives were tested in the model. Standard anionic polyacrylamide retention aids were used as controls in combination with Additive A, Kymene™ XRV20. These are noted as Additives B6, B7, B8, and B9. All four retention aids had much higher molecular weights than that of the Additive B used in Example 2. All were applied after the Additive A addition and at a ratio of 10:1, by weight, of Additive A to Additive B, on a dry basis. The paper results for Additive A alone (no Additive B) are shown in Table 4.

TABLE 4

| | Additive B | Additive A Dosage (based on dry fiber) | Ash (%) | Retention (%) | Dry Opacity |
|---|---|---|---|---|---|
| 4.1 | No Additive B | 0.0% | 28% | 60% | 97 |
| 4.2 | No Additive B | 1.0% | 33% | 73% | 98 |
| 4.3 | No Additive B | 2.0% | 28% | 62% | 97 |
| 4.4 | No Additive B | 3.0% | 26% | 56% | 96 |

| | Additive B | Additive A Dosage (based on dry fiber) | Oil Opacity | Basis Weight (gsm) | Dry Peak Load (N/m) | Wet Peak Load (N/m) |
|---|---|---|---|---|---|---|
| 4.1 | No Additive B | 0.0% | 90 | 71 | 1280 | 60 |
| 4.2 | No Additive B | 1.0% | 91 | 77 | 1531 | 430 |
| 4.3 | No Additive B | 2.0% | 89 | 75 | 1967 | 609 |
| 4.4 | No Additive B | 3.0% | 87 | 67 | 2023 | 604 |

The results for Additive A plus various comparative Additive B's (standard anionic polyacrylamide retention aids) are shown in Table 5.

TABLE 5

| | Additive B | Additive A Dosage (based on dry fiber) | Ash (%) | Retention (%) | Dry Opacity |
|---|---|---|---|---|---|
| 5.1 | Additive B6 | 1% | 40% | 88% | 97 |
| 5.2 | Additive B6 | 2% | 41% | 89% | 98 |

TABLE 5-continued

| | | | | | |
|---|---|---|---|---|---|
| 5.3 | Additive B6 | 3% | 38% | 84% | 98 |
| 5.4 | Additive B7 | 1% | 40% | 89% | 97 |
| 5.5 | Additive B7 | 2% | 42% | 92% | 97 |
| 5.6 | Additive B7 | 3% | 42% | 91% | 97 |
| 5.7 | Additive B8 | 2% | 42% | 92% | 98 |
| 5.8 | Additive B8 | 3% | 42% | 92% | 97 |
| 5.9 | Additive B9 | 3% | 40% | 87% | 97 |

| | Additive B | Additive A Dosage (based on dry fiber) | Oil Opacity | Basis Weight (gsm) | Dry Peak Load (N/m) | Wet Peak Load (N/m) |
|---|---|---|---|---|---|---|
| 5.1 | Additive B6 | 1% | 92 | 87 | 1353 | 384 |
| 5.2 | Additive B6 | 2% | 92 | 87 | 1551 | 435 |
| 5.3 | Additive B6 | 3% | 91 | 89 | 1704 | 482 |
| 5.4 | Additive B7 | 1% | 93 | 88 | 1567 | 327 |
| 5.5 | Additive B7 | 2% | 92 | 93 | 1482 | 425 |
| 5.6 | Additive B7 | 3% | 92 | 95 | 1538 | 487 |
| 5.7 | Additive B8 | 2% | 92 | 93 | 1601 | 429 |
| 5.8 | Additive B8 | 3% | 91 | 92 | 1590 | 463 |
| 5.9 | Additive B9 | 3% | 91 | 91 | 1187 | 378 |

The results showed similar improvements upon the Additive A alone in terms of opacity and retention, but the wet tensile peak load was less than those obtained in the case of the Additive A alone (comparison of Tables 4 and 5). The presence of the higher molecular weight Additive B systems resulted in poor wet and dry strength properties. Without wishing to be bound by theory, the high molecular weight anionic polyacrylamides resulted in poorer paper formation which resulted in lower strength properties likely due to excessive flocculation of the filler particles, thereby disrupting the fiber to fiber bonding essential for tensile strength.

Example 4

In this evaluation, Additive B systems within the current disclosure were tested at the same dosage as the anionic polyacrylamide retention aids tested in Table 5, Example 3. Additive A is Kymene™ XRV20. The dosage level was 10:1, by weight, of Additive A to Additive B on a dry polymer basis. The results are reported as a percentage of the sheet property obtained for the run with Additive A alone, at the same Additive A dosage. The results are shown in Table 6.

TABLE 6

| | Additive | Additive A Dosage | Retention (%) | Oil Opacity | Wet Peak Load (N/m) | Dry Peak Load (N/m) |
|---|---|---|---|---|---|---|
| 6.1 | Additive B2 | 1% | 118% | 101% | 105% | 103% |
| 6.2 | Additive B2 | 2% | 164% | 106% | 109% | 116% |

TABLE 6-continued

| | Additive | Additive A Dosage | Retention (%) | Oil Opacity | Wet Peak Load (N/m) | Dry Peak Load (N/m) |
|---|---|---|---|---|---|---|
| 6.3 | Additive B2 | 3% | 180% | 109% | 119% | 113% |
| 6.4 | Additive B3 | 1% | 122% | 103% | 111% | 109% |
| 6.5 | Additive B3 | 2% | 181% | 108% | 107% | 119% |
| 6.6 | Additive B3 | 3% | 206% | 112% | 122% | 111% |
| 6.7 | Additive B4 | 1% | 117% | 102% | 105% | 112% |
| 6.8 | Additive B4 | 2% | 152% | 106% | 117% | 113% |
| 6.9 | Additive B4 | 3% | 187% | 109% | 117% | 114% |
| 6.10 | Additive B5 | 1% | 111% | 101% | 108% | 118% |
| 6.11 | Additive B5 | 2% | 143% | 105% | 114% | 122% |
| 6.12 | Additive B5 | 3% | 158% | 106% | 118% | 115% |
| Comp. 6.13 | Additive B6 | 1% | 120% | 101% | 89% | 88% |
| Comp. 6.14 | Additive B6 | 2% | 145% | 103% | 71% | 79% |
| Comp. 6.15 | Additive B6 | 3% | 149% | 105% | 80% | 84% |
| Comp. 6.16 | Additive B7 | 1% | 121% | 102% | 76% | 102% |
| Comp. 6.17 | Additive B7 | 2% | 149% | 104% | 70% | 75% |
| Comp. 6.18 | Additive B7 | 3% | 161% | 106% | 81% | 76% |
| Comp. 6.19 | Additive B8 | 2% | 149% | 104% | 71% | 81% |
| Comp. 6.20 | Additive B8 | 3% | 164% | 105% | 77% | 79% |
| Comp. 6.21 | Additive B9 | 3% | 154% | 105% | 63% | 59% |

It is evident in this table that the Additives B2, B3, B4 and B5 systems applied showed greater retention improvements over the Additive A case alone and greater retention improvements than the conventional retention aids (Additives B6, B7, B8, and B9) at the higher Additive A addition levels. This also translates to higher opacity levels at the 2 and 3% Additive A addition levels when compared to the conventional retention aids. The biggest performance improvement is observed in the wet tensile peak load values. The results show Additives B2, B3, B4, and B5 gave improvements over the Additive A alone case, whereas those using the conventional retention aids show peak loads less than that of the Additive A alone. Additives B6, B7, B8, and B9 had a negative impact on the wet tensile strength.

It is contemplated that, in various non-limiting embodiments, all combinations of the aforementioned compounds, components, weight percents, method steps, etc. can be used with one another, even if not described in the same or similar paragraphs. In other words, all of the aforementioned combinations are hereby expressly contemplated for use in various non-limiting embodiments.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment. It being understood that various changes may be made in the function and arrangement of elements described in an exemplary embodiment without departing from the scope as set forth in the appended claims.

What is claimed is:

1. A process for making paper having opacity and filler retention, said process comprising the step of adding Additive A and Additive B to a slurry in a wet end of a paper machine wherein the slurry comprises pulp and a filler;

wherein Additive B is an anionic polymer having a charge density from about −3000 to about −7000 ueq/g on a dry basis when measured in a buffer having a pH of about 6;

wherein Additive A is a polyamidoamine-epichlorohydrin and wherein Additive B is a polyacrylamide that is the reaction product of acrylamide and acrylic acid and has a weight average molecular weight of from 173,000 to 646,000 g/mol, and wherein the slurry comprises less than 5 wt % of additives that are not Additive A or B or filler.

2. The process according to claim 1 wherein the filler is chosen from titanium dioxide, kaolin, calcium carbonate, pigments, dyes, and combinations thereof.

3. The process according to claim 1 wherein the filler is titanium dioxide.

4. The process according to claim 3 wherein the titanium dioxide is an anatase and/or rutile type.

5. The process according to claim 1 wherein the paper is décor or laminate grade paper.

6. The process according to claim 1 wherein the charge density of Additive B, measured at a pH of about 6, is from about −4000 to about −6000 ueq/g on a dry basis.

7. The process according to claim 1 wherein the slurry comprises cellulose fiber and Additive A is added in an amount of from about 1 to about 60 lbs per ton of dry cellulose fiber.

8. The process according to claim 1 wherein the slurry comprises cellulose fiber and Additive B is added in an amount of from about 0.5 to about 30 lbs per ton of dry cellulose fiber.

9. The process according to claim 1 wherein the weight ratio of Additive A to Additive B is from about 2:1 to about 20:1 on a dry weight basis.

10. The process according to claim 1 wherein the weight ratio of Additive A to Additive B is from about 4:1 to about 15:1 on a dry weight basis.

11. The process according to claim 1 wherein a ratio of filler to pulp is from about 25:100 to about 150:100 by weight on a dry basis.

12. The process according claim 1 wherein the paper has an ash content of from about 5% to about 60%, by weight.

13. The process according to claim 1 wherein the charge density of Additive B, measured at a pH of about 6, is from about −5000 to about −5500 ueq/g on a dry basis; wherein the slurry comprises cellulose fibers, wherein Additive A is added in an amount of from about 20 to about 40 lbs per ton of dry cellulose fiber, wherein Additive B is added in an amount of from about 1 to about 20 lbs per ton of dry cellulose fiber, and wherein the paper has an ash content of from about 25% to about 40%, by weight.

* * * * *